US007101319B1

(12) United States Patent
Potts

(10) Patent No.: US 7,101,319 B1
(45) Date of Patent: Sep. 5, 2006

(54) MULTIPLE PRESSURE SENSOR SPEED CONTROLLED TREADMILL

(76) Inventor: Mark J. Potts, 681 Churchill La., Oswego, IL (US) 60543

( * ) Notice: Subject to any disclaimer, the term of this patent is extended or adjusted under 35 U.S.C. 154(b) by 0 days.

(21) Appl. No.: 11/340,330

(22) Filed: Jan. 27, 2006

(51) Int. Cl.
*A63B 22/00* (2006.01)
*A63B 21/00* (2006.01)

(52) U.S. Cl. ..... 482/54; 482/8; 482/51

(58) Field of Classification Search ..... 482/1–9, 482/51, 54, 900–902; 119/700
See application file for complete search history.

(56) References Cited

U.S. PATENT DOCUMENTS 4,708,337 A 11/1987 Shyu
5,209,710 A * 5/1993 Shimizu et al. ..... 482/54
5,800,314 A 9/1998 Sakakibara et al.
6,179,754 B1 1/2001 Wang et al.
6,436,008 B1 * 8/2002 Skowronski et al. ..... 482/54
6,443,875 B1 * 9/2002 Golen, Jr. et al. ..... 482/54

* cited by examiner

*Primary Examiner*—Glenn Richman
(74) *Attorney, Agent, or Firm*—Crossley Patent Law; Mark A. Crossley

(57) ABSTRACT

A treadmill comprising a belt attached to a traveling block, the block selectively moving up and down treadmill stanchions to change incline. The treadmill is programmable regarding simulated course, distance, initial speed, and user weight, and records approximate caloric expenditure. Sensors strategically positioned below the belt upper surface regulate belt speed to keep a user toward the center of the treadmill. A port receives a removable memory device for recording and playback of user performances. Even multiple users thereby have an ongoing reference on the same machine.

19 Claims, 5 Drawing Sheets

MULTIPLE PRESSURE SENSOR SPEED CONTROLLED TREADMILL

BACKGROUND OF THE INVENTION

Exercise is commonly known to improve physical fitness and health. The muscular and cardiovascular benefits of exercise are firmly documented. Treadmills offer aerobic and anaerobic exercise in a limited space, without regard to access to running or walking areas any greater than the space occupied by the treadmill. Typical treadmills offer slope adjustment, speed adjustment, heart rate counters, mileage meters, timers, and various other well known feedback displays and recording devices. Typical modern treadmills also offer route choices, which can take a user through simulated courses of hill and dale or various other predetermined runs/walks. Typical treadmills, however, are not capable of speed changes without physical input by the operator. Those that are capable of instantaneous speed change contain unduly complex mechanisms. A user needs virtually instant speed changes to adapt the treadmill speed to conditions under which the runner/walker is either ahead or behind the pace set on the treadmill. Such speed change capabilities are not only useful but also serve as a safety net to prevent a user from colliding with the control panel or falling off of the back of the treadmill, neither an unusual occurrence. It is seldom convenient for a user to have to press or change controls to adjust speed of the treadmill. Automatic speed adjustment is therefore of particular benefit in both convenience and safety. Automatic speed control is not new to the art. The methods of automatically controlling speed, though, vary significantly. The current invention offers a unique approach to speed control.

FIELD OF THE INVENTION

The present invention relates to treadmills and more particularly to a treadmill that dictates speed by sensing the position of the user via foot strike position on the treadmill via multiple pressure sensors.

DESCRIPTION OF PRIOR ART

U.S. Pat. No. 4,708,337 to Shyu discloses a treadmill with various convenience features, including speed adjustment. The speed adjustment mechanism, however, differs significantly from the present invention, the speed adjustment means is comprised of an ultrasonic detector.

U.S. Pat. No. 6,179,754 to Wang and Wu discloses a treadmill which varies speed via side-to-side sensors. The electronic sensors are comprised of a plurality of sending terminals on one side of the treadmill with correspondingly opposite receiving terminals on the other side of the treadmill, the terminals detecting foot placement of the user. The CPU then divides the distance by two to determine the position of the user of the treadmill. This method of sensing user position differs significantly from the present invention.

U.S. Pat. No. 5,690,587 to Gruenangerldiscloses a treadmill having an automatic speed control system but does not distinctly claim and point out such.

U.S. Pat. No. 5,368,532 to Farnet discloses a speed variable treadmill which senses the forefoot and rearfoot placement of a user, with one sensor for each. As the device comprises only two sensors, one fore and one aft, the user must strike both the front and rear sensor in a given stride in order to maintain a constant speed of the treadmill belt. Having only two sensors therefore makes the device dependent upon stride length, which varies greatly by user and by speed, whether the user is running or walking. Such and arrangement, while theoretically possible, cause speed changes which are either too late to accommodate a user, or too abrupt in their execution.

SUMMARY OF THE INVENTION

The general purpose of the multiple pressure sensor speed controlled treadmill, described subsequently in greater detail, is to provide a multiple pressure sensor speed controlled treadmill which has many novel features that result in an improved multiple pressure sensor speed controlled treadmill which is not anticipated, rendered obvious, suggested, or even implied by prior art, either alone or in combination thereof.

In view of the foregoing disadvantages inherent in the known types of sensor speed controlled treadmills now present in the prior art, the improved multiple pressure sensor speed controlled treadmill overcomes the above-mentioned disadvantages and drawbacks or the prior art. As such, the general purpose of the improved multiple pressure sensor speed controlled treadmill, described subsequently in greater detail, is to provide a new and improved multiple pressure sensor speed controlled treadmill which has all of the advantages of the prior art mentioned heretofore and many novel features that result in an improved multiple pressure sensor speed controlled treadmill which is not anticipated, rendered obvious, suggested, or even implied by the prior art, either alone or in combination thereof.

To attain this, the present invention comprises a treadmill of typical outward appearance and drive motor. Beyond these traits common to more than one treadmill known in the art, the present invention varies significantly.

The upper surface of the revolving belt upon which a user performs is equipped, on the underside, with three sensors. The sensor nearest the front of the belt is an acceleration sensor. The acceleration sensor causes the speed of the rotating belt to increase when the belt is compressed against it by a user's foot. An increase in speed of the belt thereby carries a user back toward the midpoint of the belt upper surface, the most desirable position for a user to be in. Conversely, the deceleration sensor is disposed below the belt proximal to the rear of the drive assembly of the treadmill. When the belt is caused to be compressed against the rear sensor by a user's foot strike, the belt communicates that information to the CPU which in turn slows the belt speed, providing for the user to return to the midpoint of the rotating belt. The target speed sensor is disposed midpoint below the belt upper surface. The target speed sensor maintains belt speed, as the user is ideally positioned when in the center. Through these mechanisms, the present invention automatically adjusts to the momentary speed of the runner or walker, through any course. No impact on the sensors stops the treadmill. Courses are chosen via the controls of the control panel. Courses are chosen by length, difficulty, and speed. The course selections offer hills and dales to more fully simulate real running and walking. The traveling block of the drive assembly travels up and down the stanchions, on either end of the traveling block. The bottom of the stanchions feature extended platforms for invention stability. The stanchions are topped with the housing for the CPU and handles for the convenience of a user as needed. The rear of the drive assembly is equipped with a skid. The skid is surfaced, on the bottom, with a slideable material.

The skid must slide in order for the drive assembly to raise and lower correctly in changing the incline of the belt. The control panel is atop the housing. The control panel further offers a view of the course chosen by a user, and visibly plots the user's progress along the course. The control panel also provides for input of body weight. With the above parameters, the CPU of the invention can calculate approximate caloric expenditure of a user.

A further distinct function of the control panel and CPU capabilities of the invention is the port which provides for a memory device to be removably plugged into the invention. Such memory devices are well known in the computer arts and include but are not limited to those referred to as memory sticks and memory cards. These removable memory devices allow a user to not only retain past performances but to record every performance, and to recall it, on the display of the control panel. Such an important feature is not only useful at home, but especially so in a commercial setting where multiple individuals use the same treadmill.

Thus has been broadly outlined the more important features of the improved multiple pressure sensor speed controlled treadmill so that the detailed description thereof that follows may be better understood and in order that the present contribution to the art may be better appreciated.

Numerous objects, features and advantages of the improved multiple pressure sensor speed controlled treadmill will be readily apparent to those of ordinary skill in the art upon reading the following detailed description of presently preferred, but nonetheless illustrative, embodiments of the improved multiple pressure sensor speed controlled treadmill when taken in conjunction with the accompanying drawings. In this respect, before explaining the current embodiments of the improved multiple pressure sensor speed controlled treadmill in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and systems for carrying out the several purposes of the improved multiple pressure sensor speed controlled treadmill. It is therefore important that the claims be regarded as including such equivalent constructions insofar as they do not depart from the spirit and scope of the present invention.

Thus has been broadly outlined the more important features of the multiple pressure sensor speed controlled treadmill so that the detailed description thereof that follows may be better understood and in order that the present contribution to the art may be better appreciated.

Numerous objects, features and advantages of the multiple pressure sensor speed controlled treadmill will be readily apparent to those of ordinary skill in the art upon reading the following detailed description of presently preferred, but nonetheless illustrative, examples of the multiple sensor speed controlled treadmill when taken in conjunction with the accompanying drawings. In this respect, before explaining the current examples of the multiple pressure sensor speed controlled treadmill in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the multiple pressure sensor speed controlled treadmill. It is therefore important that the claims be regarded as including such equivalent constructions insofar as they do not depart from the spirit and scope of the present invention.

It is therefore an object of the invention to provide automatic speed control for the user.

It is a further object of the invention to provide user input in determining course, speed, terrain, and duration of treadmill use.

Another object of the invention is to provide for smooth movement of the rear skid of the treadmill across surfaces as the treadmill inclines and declines.

It is also an object of the invention to provide cessation of operation should a user leave the treadmill or cease treadmill impact.

It is an added object of the invention to provide a smooth transition between speed changes.

An additional object of the invention is to provide speed changes via a basic mechanism.

Still a further object of the invention is to provide for removable memory input into the treadmill.

These together with additional objects of the improved multiple sensor speed controlled treadmill, along with various novel features that characterize the invention are particularly pointed out in the claims forming a part of this disclosure. For better understanding of the improved multiple pressure sensor speed controlled treadmill, its operating advantages and specific objects attained by it uses, refer to the accompanying drawings and description.

DETAILED DESCRIPTION OF THE DRAWINGS

With reference now to the drawings, and in particular FIGS. 1 through 5 thereof, example of the employing the principles and concepts of the present invention and generally designated by the reference number 10 will be described.

Figure 1:
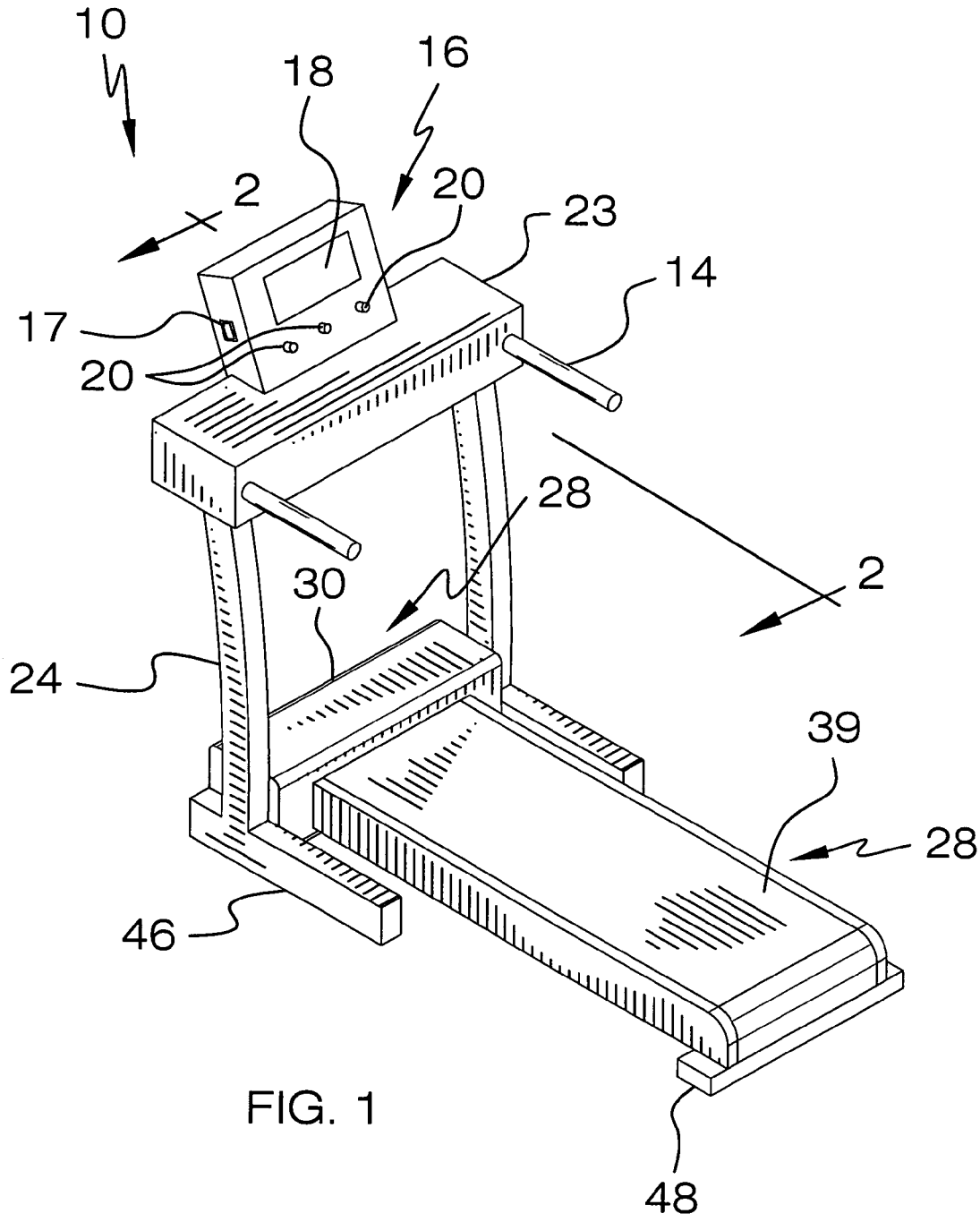
FIG. 1 is a perspective view with the belt in the level position.
Figure 2:
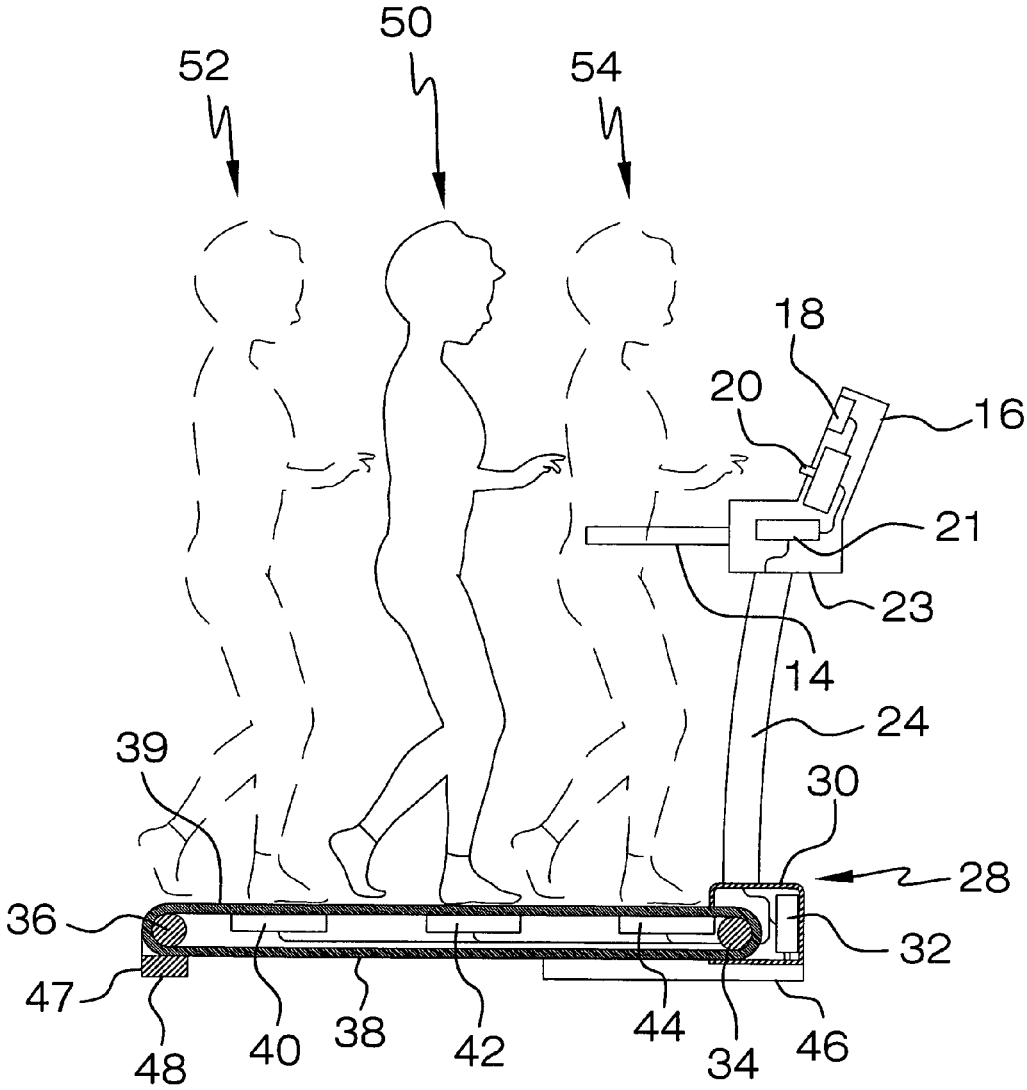
FIG. 2 is a side cross sectional view of FIG. 1.

Referring to FIGS. 1 and 2, the invention 10 comprises a treadmill having a drive assembly 28. The belt 38 and drive assembly 28 are illustrated in the horizontal position. The drive assembly 28 has a front and a rear. The drive assembly 28 is also comprised of a parallelepiped traveling block 30 at the front end of the drive assembly 28. The block 30 has two opposite ends. An incline motor 32 is disposed within the traveling block 30. A spaced apart pair of vertical stanchions 24 is attached to opposite ends of the block 30. Each stanchion 24 has a platform 46 disposed at the bottom of the stanchion 24 to support the invention 10. The horizontally disposed traveling block 30 is vertically and simultaneously movable along the height of each stanchion 24 via the incline motor 32. The incline motor 32 is disposed within the traveling block 30. A skid 47 is disposed at the rear of the drive assembly 28. The bottom of the skid 47 is surfaced with a slideable material 48 such that the skid 47 moves across a given surface as the drive assembly 28 is raised and lowered in the inclined positions. As raising and lowering the angle of the drive assembly 28 must allow movement of the rear skid 47, the slideable material 48 is an important feature of the invention 10. The rotatable belt 38 has a front area, a midpoint, and a rear area. The belt 38 further has an upper surface 39 for user 50 contact, The belt 38 rotation is perpendicular to the traveling block 30. The drive roller 34 is in communication with the belt 38. The drive roller 34 is disposed at the front of the drive assembly 28. The drive motor (not shown) is in communication with the drive roller 34. The rear roller 36 is in communication with the belt 38. The rear roller 36 is disposed at the rear of the drive assembly 28. Three speed detection sensors are disposed below the upper surface of the belt 38. The detection sensors are comprised of an acceleration sensor 44 disposed proximal to the front area of the belt, 38, a target speed sensor 42 disposed proximal to the midpoint of the belt 38, and a deceleration sensor 40 is disposed proximal to the rear of the belt 38, whereby the speed of the belt 38 is smoothly transitioned to regulate the user's 50 position toward the midpoint of the upper surface 39 of the belt 38. Rear positioned user 52, as example, has slowed such that firm belt 38 contact is made with the deceleration sensor 40, thereby slowing the belt 38 rotation such that the user 50 returns to the midpoint of the belt upper surface 39. The front positioned user 54 causes firm contact of the belt upper surface 39 such that the belt 38 rotation speeds up, thereby returning the front positioned user 54 to an ideally positioned user 50 in the midpoint of the belt. This important feature prevents a user from losing speed control, falling off of the treadmill, or colliding with the housing 23. Such mistakes are common among treadmill users 50 and are caused by fatigue, course changes, and other factors that enter into the exercise routine. The basic method presented by the invention 10 is unique in the art. The housing 23 is affixed atop the stanchions 24. The CPU 21 is disposed within the housing 23. The CPU 21 is in communication with the drive motor (not shown) and the incline motor 32. The drive motor is not unique in the art of treadmills. The control panel 16 is affixed to the housing 23 such that user 50 visibility is maximized. The control panel 16 is in communication with the CPU 21. The control panel 16 comprises input controls 20 for programming a simulated course for walking and running, input controls 20 for programming difficulty of the course, and input controls 20 for initially programming course speed.

Course speed changes are momentarily altered by the above-described mechanisms of pressure sensors and CPU input and feedback. A port 17 is disposed on the control panel 16. The port 17 is for removable insertion of a memory device (not shown). Such memory devices are common among computer related arts. Some are referred to as memory cards, some as memory sticks, as example, whereby previous and current treadmill performances are recorded and available to the user 50. This feature is useful for all of the treadmills produced under the current invention 10 but even more so with those used in commercial establishments wherein countless users 50 may utilize a given treadmill, thereby having their past and future performances at their visual and tactile access. The housing 23 also provides rearwardly facing handles 14 for user convenience. The control panel display 18 displays the chosen course to be attempted by the user 50. The preferably example of the invention 10 displays the user's 50 position on the course. The preferred example of the invention 10 also allows the user's weight to be programmed into the control panel 16. The preferred example of the invention 10 displays and records the user's approximate caloric expenditure.

Figure 3:
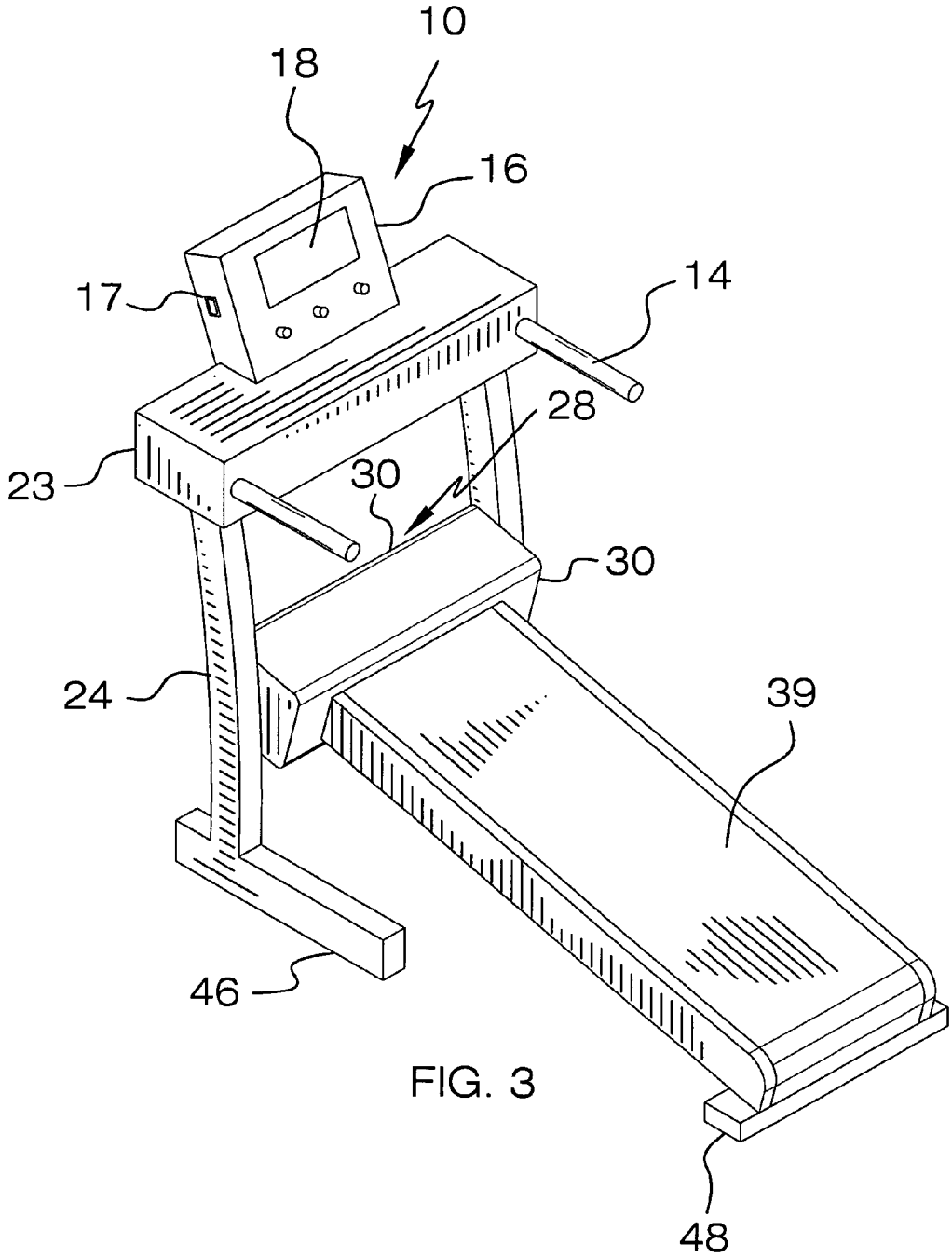
FIG. 3 is perspective view with the drive assembly in an inclined position.

Referring to FIG. 3, the drive assembly 28 is illustrated in the inclined position. The traveling block 30 has moved upwards on the stanchions 24 via input from either the user 50 or the selected course program from the control panel 16 instructing the CPU 21. The incline and decline may take place at any time and is determined via instantaneous input by the user 50 or the program selected.

Figure 4:
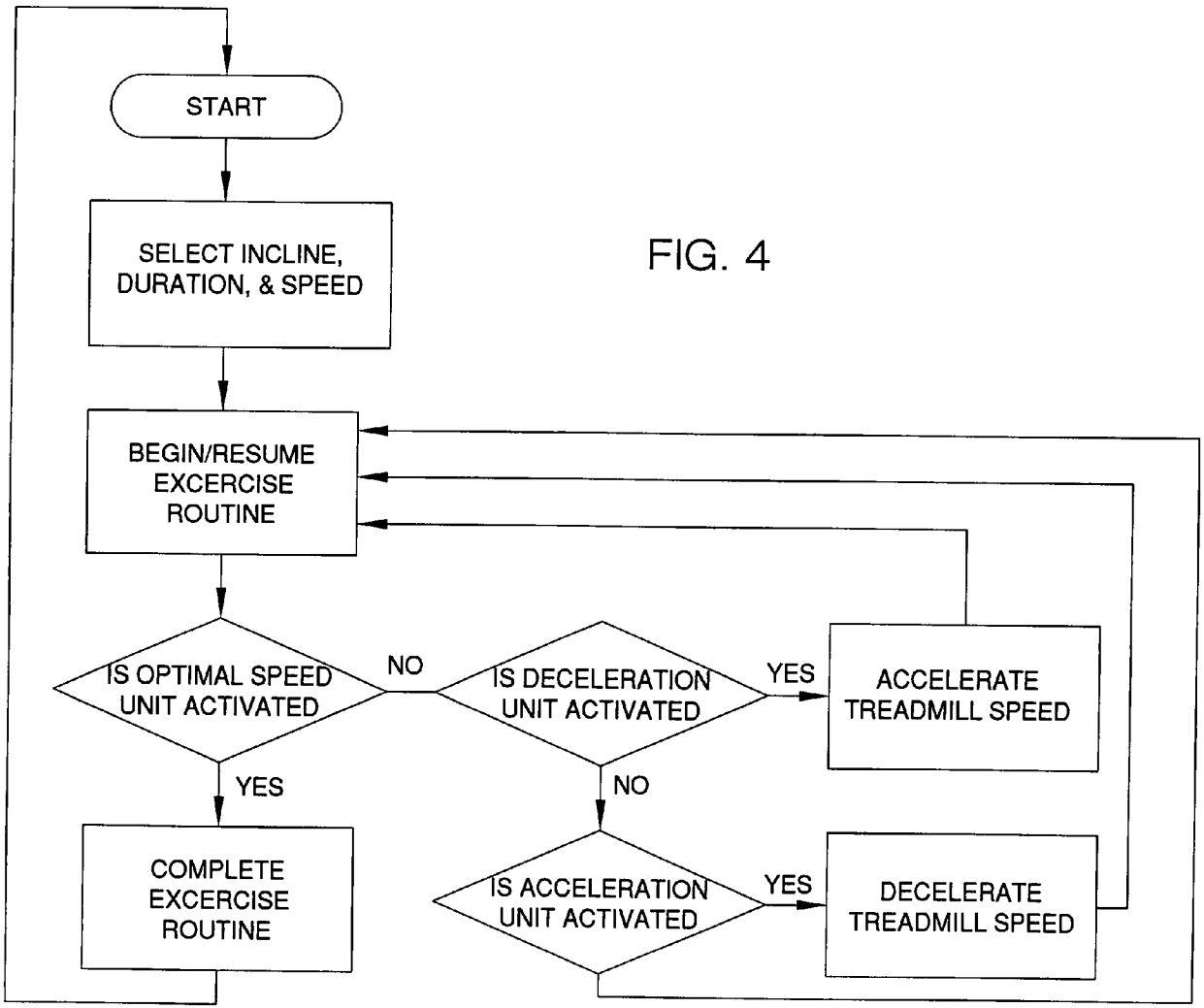
FIG. 4 is a schematic block diagram of the operation of the treadmill in adjusting to a user's speed.

Referring to FIG. 4, interaction of the user 50 and the functions of the invention 10 are depicted. The user 50 pushes start. The user 50 then selects initial incline, speed, and duration of an exercise event, or even repeat of an event. When optimal speed is activated, via the user 50 striking the center placed ideal user position sensor, speed of the belt 38 is maintained automatically. If the user trails behind the speed of the belt 38 and causes contact of deceleration sensor 40 at the rear of the belt 38, the CPU 21 instructs the belt 38 rotation to slow, thereby providing for the user 50 to return to the midpoint of the belt 38. If, instead, at any time, the front disposed acceleration sensor 44 is caused to contact the belt 38 firmly, the belt 38 speed is increased in effort to return the user 50 to the midpoint of the belt upper surface 39. This is a continuous loop function until the user 50 stops the exercise routine. The automatic and smooth transition of the invention's 10 belt 38 speed, along with its basic nature, is a valuable function known to anyone who has used a treadmill.

Figure 5:
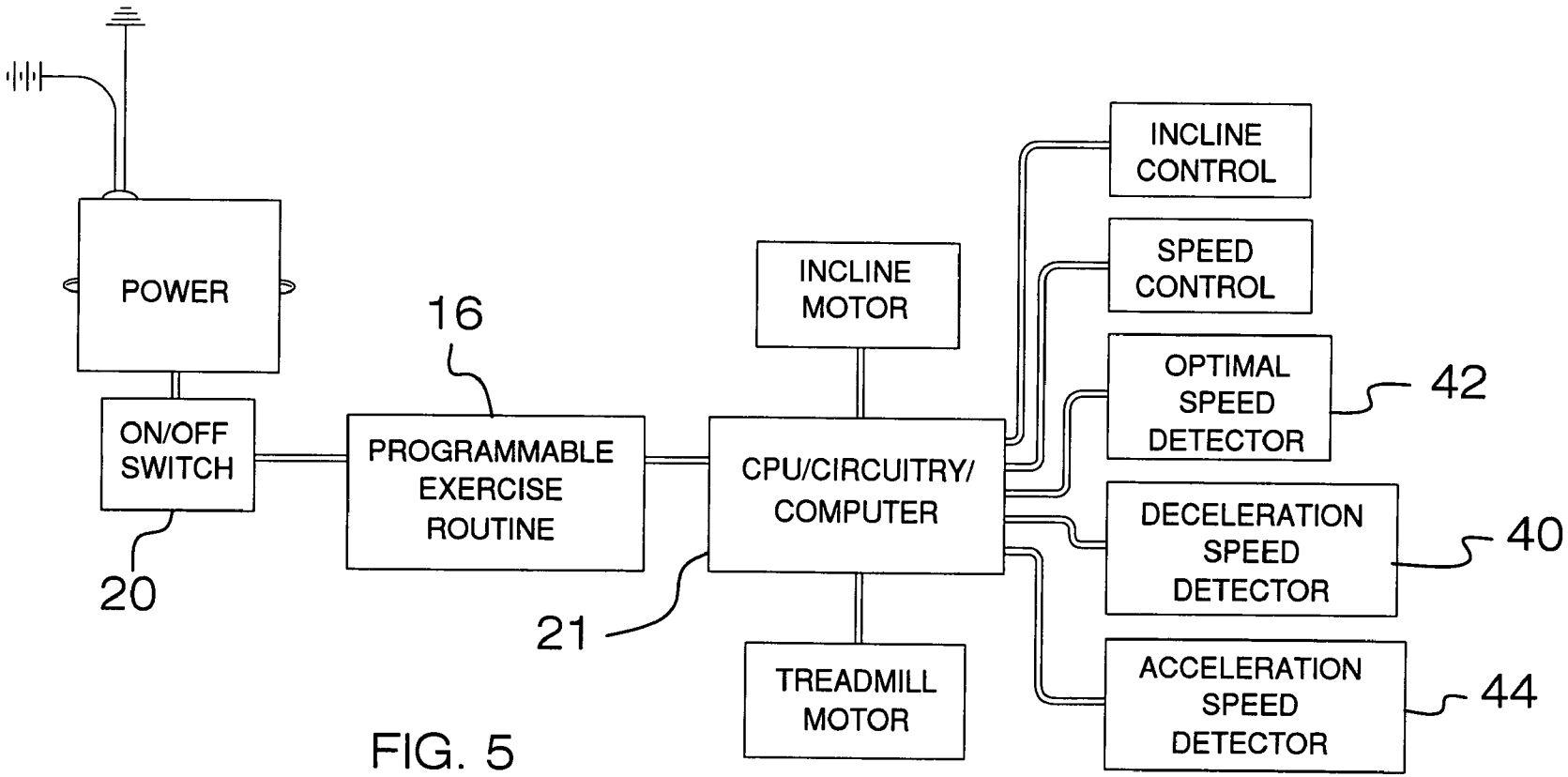
FIG. 5 is a schematic block diagram of the circuitry.

Referring to FIG. 5, the schematic block diagram illustrates power supply to the on/off switch, which feeds the programmable control panel 16 which communicates with the CPU 21. The CPU 21, as previously outlined, commands the incline motor 32 and the drive motor. The incline motor 32 and the drive motor are thereby influenced by the speed sensor, including the deceleration sensor 40, the ideal or optimal target speed sensor 42, and the acceleration sensor 44. A user 50 is thereby automatically influenced to be near or at the target speed sensor 42 disposed beneath the midpoint of the belt upper surface 39.

With respect to the above description then, it is to be realized that the optimum dimensional relationships for the parts of the multiple pressure sensor speed controlled treadmill, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A treadmill having a drive assembly;

the drive assembly having a front and a rear, the drive assembly comprised of:

a parallelepiped block containing a drive motor, the block having two opposite ends;

a rotatable belt, the belt having a front area, a midpoint, and a rear area, the belt further having an upper surface for user contact, the belt rotation perpendicular to the block;

a drive roller in communication with the belt, the drive roller disposed at the front of the drive assembly;

a drive motor incommunication with the roller;

a rear roller in communication with the belt, the rear roller at the rear of the drive assembly;

a spaced apart pair of vertical stanchions attached to the opposite ends of the block;

a platform perpendicularly affixed to a bottom of each stanchion;

a skid attached proximal to the rear of the drive assembly;

a bottom of the skid equipped with a slideable material for sliding across surfaces;

a housing affixed atop the stanchions;

a CPU disposed within the housing, the CPU in communication with the drive motor;

a control panel affixed to the housing, the control panel in communication with the CPU, the control panel comprising:

means for programming a simulated course for walking and running;

means for programming difficulty of the course;

means for initially programming course speed;

three speed detection sensors disposed below the belt upper surface, the detection sensors comprised of:

an acceleration sensor disposed proximal to the front area of the belt;

a target speed sensor disposed proximal to the midpoint of the belt;

a deceleration sensor disposed proximal to the rear of the belt, whereby the speed of the belt is smoothly transitioned to regulate the user's position toward the midpoint of the belt upper surface.

2. The invention in claim 1 wherein the control panel further comprises a display of the course.

3. The invention in claim 2 wherein the user's position on the course is displayed.

4. The invention in claim 3 wherein the user's weight is programmed into the control panel.

5. The invention in claim 4 wherein the user's approximate caloric expenditure is displayed.

6. The invention in claim 5 wherein the course length is programmable by the user.

7. A treadmill having a drive assembly;

the drive assembly having a front and a rear, the drive assembly comprised of:

a parallelepiped traveling block, the block having two opposite ends;

an incline motor disposed within the traveling block;

a spaced apart pair of vertical stanchions attached to opposite ends of the driving block, the traveling block simultaneously and vertically movable along a height of each stanchion via the inclined motor;

a skid disposed at the rear of the drive assembly;

a bottom of the skid equipped with a slideable material for sliding across surfaces;

a rotatable belt, the belt having a front area, a midpoint, and a rear area, the belt further having a belt upper surface for user contact, the belt rotation perpendicular to the traveling block;

a drive roller in communication with the belt, the drive roller disposed at the front of the drive assembly;

a drive motor in communication with the roller;

a rear roller in communication with the belt, the rear roller at the rear of the drive assembly;

three speed detection sensors disposed below the belt upper surface, the detection sensors comprised of:

an acceleration sensor disposed proximal to the front area of the belt;

a target speed sensor disposed proximal to the midpoint of the belt;

a deceleration sensor disposed proximal to the rear of the belt, whereby the speed of the belt is smoothly transitioned to regulate the user's position toward the midpoint of the upper surface of the belt;

a housing affixed atop the stanchions;

a CPU disposed within the housing, the CPU in communication with the drive motor and the incline motor;

a control panel affixed to the housing, the control panel in communication with the CPU, the control panel comprising:

means for programming a simulated course for walking and running;

means for programming difficulty of the course;

means for initially programming course speed.

8. The invention in claim 7 wherein the control panel further comprises a display of the course.

9. The invention in claim 8 wherein the user's position on the course is displayed.

10. The invention in claim 7 wherein the user's weight is programmed into the control panel.

11. The invention in claim 10 wherein the user's approximate caloric expenditure is displayed.

12. The invention in claim 8 wherein the user's weight is programmed into the control panel.

13. The invention in claim 9 wherein the user's weight is programmed into the control panel.

14. The invention in claim 13 wherein the user's approximate caloric expenditure is displayed.

15. A treadmill having a drive assembly;

the drive assembly having a front and a rear, the drive assembly comprised of:

a parallelepiped traveling block, the block having two opposite ends;

an incline motor disposed within the traveling block;

a spaced apart pair of vertical stanchions attached to opposite ends of the traveling block, the traveling block simultaneously and vertically movable along a height of each stanchion via the incline motor;

a skid disposed at the rear of the drive assembly;

a bottom of the skid equipped with a material for sliding across surfaces;

a rotatable belt, the belt having a front area, a midpoint, and a rear area, the belt further having an upper surface for user contact, the belt rotation perpendicular to the traveling block;

a drive roller in communication with the belt, the drive roller disposed at the front of the drive assembly;

a drive motor in communication with the drive roller;

a rear roller in communication with the belt, the rear roller at the rear of the drive assembly;

three speed detection sensors disposed below the belt upper surface, the detection sensors comprised of:

an acceleration sensor disposed proximal to the front area of the belt;

a target speed sensor disposed proximal to the midpoint of the belt;

a deceleration sensor disposed proximal to the rear of the belt, whereby the speed of the belt is smoothly transitioned to regulate the user's position toward the midpoint of the upper surface of the belt;

a housing affixed atop the stanchions;

a CPU disposed within the housing, the CPU in communication with the drive motor and the incline motor;

a control panel affixed to the housing, the control panel in communication with the CPU, the control panel comprising:

means for programming a simulated course for walking and running;

means for programming difficulty of the course;

means for initially programming course speed;

a port disposed on the control panel, the port for removable insertion of a memory device, whereby previous and current treadmill performances are recorded and available to the user.

16. The invention in claim 15 wherein the control panel further comprises a display of the course.

17. The invention in claim 16 wherein the user's position on the course is displayed.

18. The invention in claim 17 wherein the user's weight is programmed into the control panel.

19. The invention in claim 18 wherein the user's approximate caloric expenditure is displayed.

* * * * *